United States Patent [19]

Bradford

[11] Patent Number: 4,592,555

[45] Date of Patent: Jun. 3, 1986

[54] SPORTS GAME

[76] Inventor: Joseph Bradford, 11145 Cypress Glenn Ave., Baton Rouge, La. 70807

[21] Appl. No.: 618,378

[22] Filed: Jun. 7, 1984

[51] Int. Cl.[4] ..... A63B 67/00

[52] U.S. Cl. ..... 273/402

[58] Field of Search ..... 273/402, 398–401, 273/29, 411, 426

[56] References Cited

U.S. PATENT DOCUMENTS

| | | | |
|---|---|---|---|
| 574,087 | 12/1896 | Frick | 273/402 |
| 1,258,931 | 3/1918 | Newcombe | 273/402 |
| 3,435,487 | 4/1969 | Mazzei et al. | 273/29 BC X |
| 4,168,066 | 9/1979 | Sole et al. | 273/402 |
| 4,284,278 | 8/1981 | Bradford | 273/426 |
| 4,407,507 | 10/1983 | Caruso et al. | 273/400 |

FOREIGN PATENT DOCUMENTS

| | | | |
|---|---|---|---|
| 2535860 | 2/1977 | Fed. Rep. of Germany | 273/402 |
| 19270 | of 1896 | United Kingdom | 273/29 BD |

OTHER PUBLICATIONS

Strength & Health, 5–1980, p. 33.

*Primary Examiner*—Paul E. Shapiro

[57] ABSTRACT

A sports game having at least two tubular poles divided into two sections, upper and lower. These two poles are used to support a flexible rectangular barricade.

A flexible barricade is a rectangular shaped device with three windows, left side, middle, and right side. The rectangular barricade is supported by two iron rods at the base of each tubular pole. Anchor lines are secondary support for the barricade. The barricade assembly was designed to allow a flying object to fly through one of the three windows. It is also a point indicator that aids in the player's perception of a flying device thrown by his opponent.

3 Claims, 8 Drawing Figures

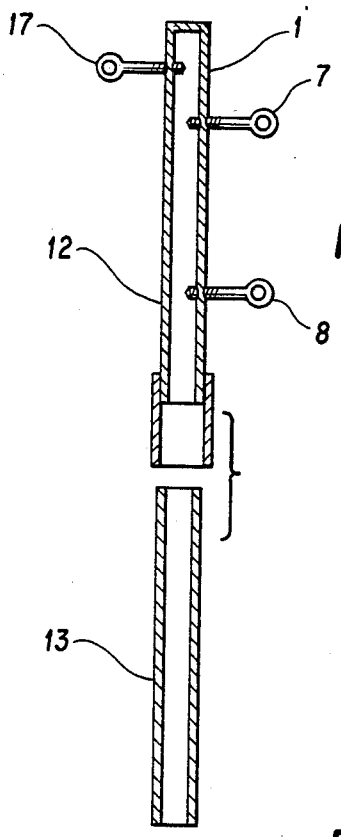
FIG. 2
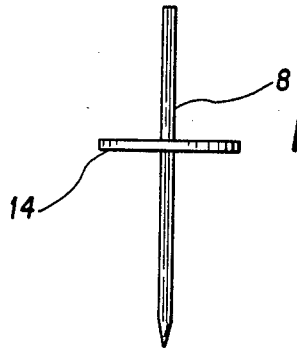
FIG. 3
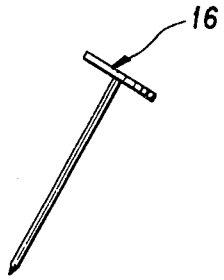
FIG. 4
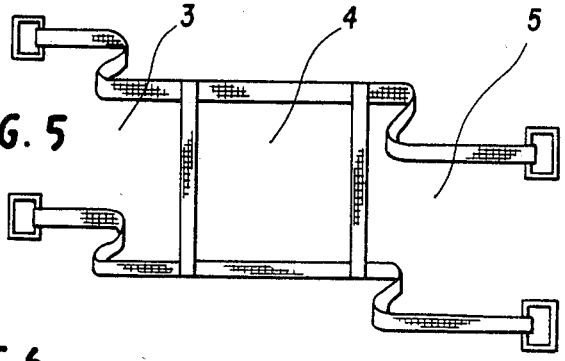
FIG. 5
FIG. 6
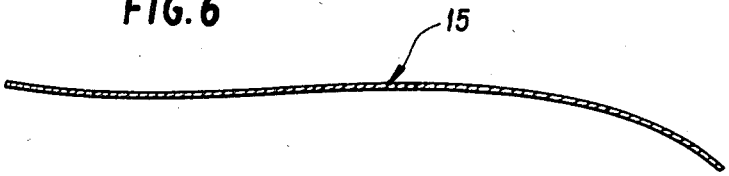
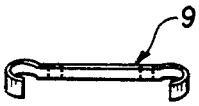
FIG. 7
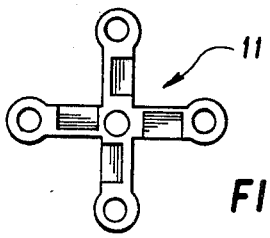
FIG. 8

SPORTS GAME

BACKGROUND OF THE INVENTION

FIELD OF THE INVENTION

The invention relates generally to sport games that use a fixed obstacle to separate the playing area, dividing the area into two equal parts. The fixed barricade is a neutral zone. The area behind each side of the neutral zone is the area where a player can retrieve a flying device after it has been thrown through one of the barricade's window openings.

This invention also relates to the following sports game: tennis, volleyball, global ball, and hocker ball. Tennis and volleyball require the players to hit the ball over the obstacle. In global ball and hocker ball, the players must hit the ball through an opening in the net.

SUMMARY OF THE INVENTION

The flight game described herein is a sports game with two elements or devices. They include a flying device and a barricade. Barricade construction includes two tubular poles, designed to hold the rectangular flexible barricade.

The poles are made into two sections, the upper and lower section. Three eye bolts are mounted on the upper section of each pole. The two inside eye bolts are used to support the rectangular flexible barricade spaced between the two tubular poles. The rear eye bolts are mounted opposite the two tubular inside eye bolts. Anchor lines are secondary support connected to rear eye bolt and anchor rods. The anchor rods and lines are used to support tubular poles. Iron rods are used for primary support. They help keep the two tubular poles in a fixed vertical position.

The rectangular barricade is flexible with three window openings. They were designed to allow a flying device to be thrown through the openings. The object of this sports invention is to throw a flying device through one of the barricade's windows. If your opponent fails to retrieve the flying device in flight, the thrower can score points and win the game.

DESCRIPTION OF THE DRAWING

FIG. 2. Tubular pole, each divided into two sections, upper and lower.

FIG. 3. Iron rod

FIG. 4. Anchor rod

FIG. 5. Flexible Rectangular barricade with three windows, left, right, and middle.

FIG. 6. Anchor line

FIG. 7. Rubber strap

FIG. 8. Flying device

DESCRIPTION OF THE PREFERRED EMBODIMENT

Figure 1:
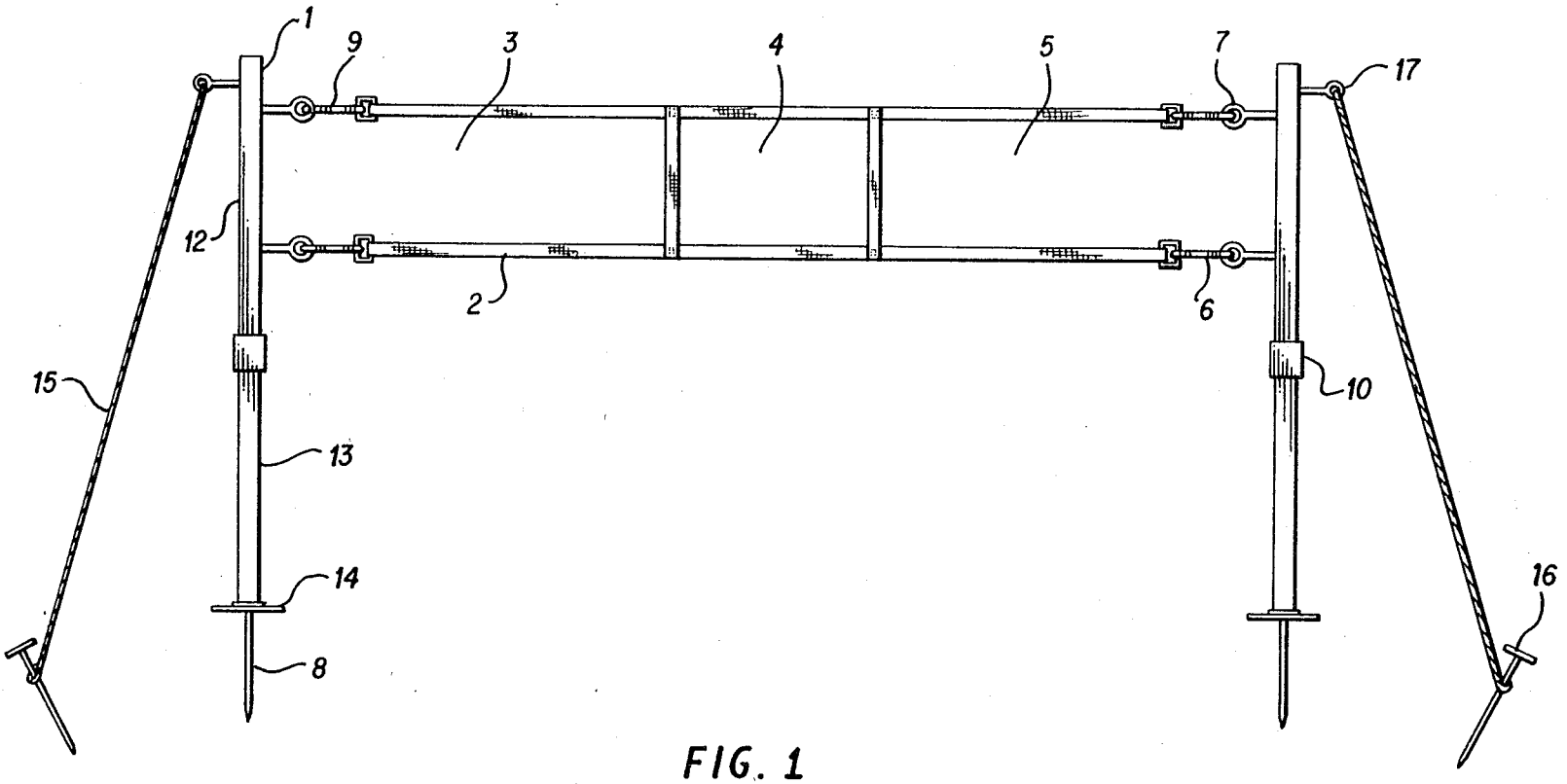
FIG. 1. Barricade assembly and flying device.

Referring now to FIGS. 1, 2, 6, 7, and 8 are all formed formed of durable and light weight material.

Iron rod FIG. 3. is made from heavy durable metal to secure the rectangular barricade assembly FIG. 1. in a Horizontal position.

Tubular shaped pole FIG. 2. which is divided in two sections, upper 12 and lower 13. Upper section 12 has three eye bolts 7 & 8 and 17 attached to support flexible barricade FIG. 5. in a stationary Horizontal position. Lower section 13 supports upper section 12, and flexible barricade FIG. 5. Lower section 13 is tubular in shape. Lower section 13 stabilizes barricade assembly FIG. 1. in a fixed position.

Anchor rod FIG. 4. is attached to rear eye bolt 17. Eye bolts 7 & 8 and 17 are screwed to top and bottom of upper pole 12. Upper pole section 12 connected to lower pole 13 section. Lower pole section 13 is tubular in design.

Iron rod FIG. 3. is a long solid rod tapered to allow lower pole 13 to slide over iron rod top section 8. Iron rod FIG. 3. helps to keep tubular pole FIG. 2. in vertical position. Iron rod stopper 14 located near the shorter end of iron rod 8. The rod stopper 14 prevents iron rod FIG. 2. from sinking too deep into the ground and keep barricade FIG. 2. Horizontally in place. Anchor line 15 connected to anchor rod 16 and rear eye bolt 17 to support barricade FIG. 1.

Flexible Barricade FIG. 5. has three larger windows 3, 4, and 5 Barricade 2 is flexible and made from light weight material Windows 3, 4, and 5 were designed to allow a flying device 11 to thrown freely from one side of the barricade to the other Rubber strap 9 mounted at the end of the rectangular shaped barricade FIG. 5.

I claim:

1. A Sports game comprising:

(a) a pair of tubular poles;

(b) a pair of elongate ground rods each having a first portion for insertion into the ground and a second portion for telescopic reception of one of said tubular poles thereover, said tubular poles being telescopically received over the second portions of said rods;

(c) a flexible barricade extending between said poles, said barricade comprising a pair of generally parallel straps mounted horizontally between said poles and a pair of vertical straps connected to said pair of horizontally mounted straps and spaced from each other to define three target openings;

(d) a rubber strap connecting each end of each of said pair of horizontal straps to said poles to maintain tension in said barricade to keep it from sagging and;

(e) an aerodynamic flying device for throwing through said target openings.

2. The sports game device of claim 1 further comprising a plate securred to each of said rods between said first and second portions.

3. The sports game device of claim 1, further comprising each of said poles having a plurality of detachably connected sections.

* * * * *